US007158002B2

(12) United States Patent
Lerchenmueller et al.

(10) Patent No.: US 7,158,002 B2
(45) Date of Patent: Jan. 2, 2007

(54) PRIMARY WIRE WINDING HAVING OPTIMIZED PACKAGE DIMENSIONS FOR A PENCIL-STYLE IGNITION COIL

(75) Inventors: Klaus Lerchenmueller, Immenstadt (DE); Konstantin Lindenthal, Blaichach (DE)

(73) Assignee: Robert Bosch GmbH, Stuttgart (DE)

( * ) Notice: Subject to any disclaimer, the term of this patent is extended or adjusted under 35 U.S.C. 154(b) by 104 days.

(21) Appl. No.: 10/680,921

(22) Filed: Oct. 8, 2003

(65) Prior Publication Data

US 2004/0130424 A1 Jul. 8, 2004

(30) Foreign Application Priority Data

Oct. 11, 2002 (DE) ..... 102 47 411

(51) Int. Cl.
*H01F 27/02* (2006.01)

(52) U.S. Cl. ..... 336/90; 336/92; 336/96

(58) Field of Classification Search ..... 336/90, 336/92, 96; 123/634–635
See application file for complete search history.

(56) References Cited

U.S. PATENT DOCUMENTS 5,008,643 A 4/1991 Heritier-Best
5,558,074 A * 9/1996 Fukatsu et al. ..... 123/647
5,740,787 A * 4/1998 Ando ..... 123/635
5,872,163 A * 2/1999 Hollstein et al. ..... 523/216
6,191,675 B1 * 2/2001 Sudo et al. ..... 336/96
6,255,930 B1 * 7/2001 Kanazawa et al. ..... 336/96
6,343,595 B1 * 2/2002 Nakabayashi et al. ..... 123/634
6,386,189 B1 * 5/2002 Shimada et al. ..... 123/634
6,529,111 B1 3/2003 Kimata et al.
6,781,500 B1 * 8/2004 Kawai et al. ..... 336/198
2004/0104796 A1 * 6/2004 Kawai et al. ..... 336/90

FOREIGN PATENT DOCUMENTS

| | | |
|---|---|---|
| DE | 198 05 628 | 9/1999 |
| EP | 1 026 394 | 8/2000 |
| JP | 09-129470 | 5/1997 |

* cited by examiner

*Primary Examiner*—Anh Mai
(74) *Attorney, Agent, or Firm*—Kenyon & Kenyon LLP

(57) ABSTRACT

To optimize the package dimensions of pencil-style ignition coils, a structural component including a primary wire and a primary bobbin is constructed in such manner that this structural component is also used as the encapsulation layer of the ignition coil.

3 Claims, 1 Drawing Sheet new

Related Art new

Related Art

PRIMARY WIRE WINDING HAVING OPTIMIZED PACKAGE DIMENSIONS FOR A PENCIL-STYLE IGNITION COIL

FIELD OF THE INVENTION

The present invention relates to a pencil-style (bar-type) ignition coil essentially including a primary and a secondary winding, each of which is wound around a bobbin and is radially separated from the other by an insulator.

BACKGROUND INFORMATION

The geometrical configuration of pencil-style ignition coils must be highly sophisticated in order to satisfy customer requirements regarding electrical performance for the smallest possible package dimensions.

Pencil-style ignition coils usually include a core, around which first a secondary bobbin and then a secondary winding are situated radially from the inside out. An insulation layer made from casting resin is provided before the primary bobbin is placed thereon. The primary bobbin sealingly encloses the pencil-style ignition coil together with a casting resin layer and an encapsulation layer. In order to accommodate the wires of the primary and secondary windings, the bobbins used are usually cylindrical. However, these bobbins have radial package dimensions that reduce the essential insulation separations (casting resin) and the gaps for introducing the sealing compound (also casting resin).

SUMMARY OF THE INVENTION

An object of the present invention is to optimize the package dimensions of a pencil-style ignition coil.

In order to achieve this object, it is provided according to the present invention that the primary winding be cast in a cylindrical ring element as a single structural component.

The present invention has the advantage that the bobbin for the primary winding, otherwise referred to as the primary bobbin, may be dispensed with. The casting resin layer for the outer ignition coil encapsulation layer may also be dispensed with. As a result, the radial package dimensions may be considerably increased. The package dimensions within the encapsulation layer may be used advantageously to accommodate other components, for example connecting elements, electrical insulators, environmental protection mechanisms, etc.

A further significant advantage of the present invention is that the primary winding is protected from environmental influences, since the wire winding is completely enclosed in injection molded plastic.

It is not necessary to enclose the wire in injection molded plastic internally. The unenclosed wire windings inside the device are impregnated with the sealing compound during the sealing process, thereby providing an effective measure to counter partial discharge effects, which may otherwise only be achieved with the aid of additional measures.

A further advantage is obtained due to the fact that wires having round and angled cross-sections may be used.

The larger space between the two windings that is obtained with these optimized package dimensions means that the electrical performance of the pencil-style ignition coil may be improved, since the mutual capacitances of the windings are reduced.

DETAILED DESCRIPTION

Figure 1:
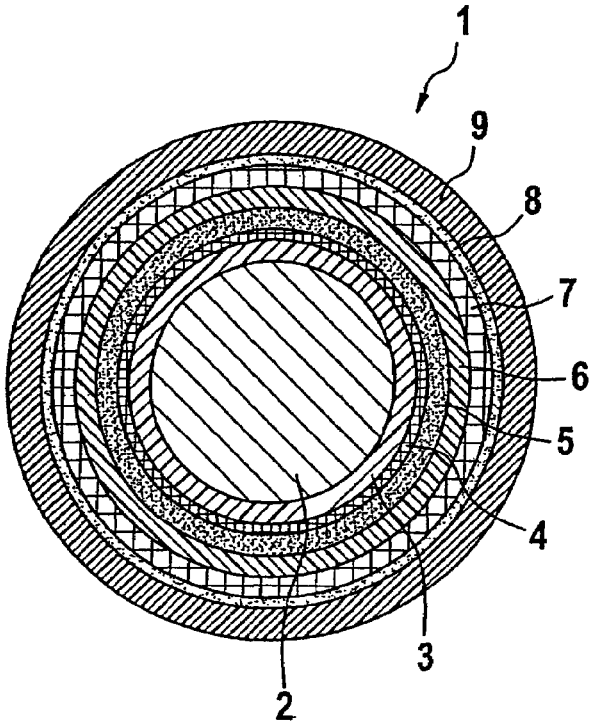
FIG. 1 shows a cross-section of an ignition coil according to the related art.
Figure 2:
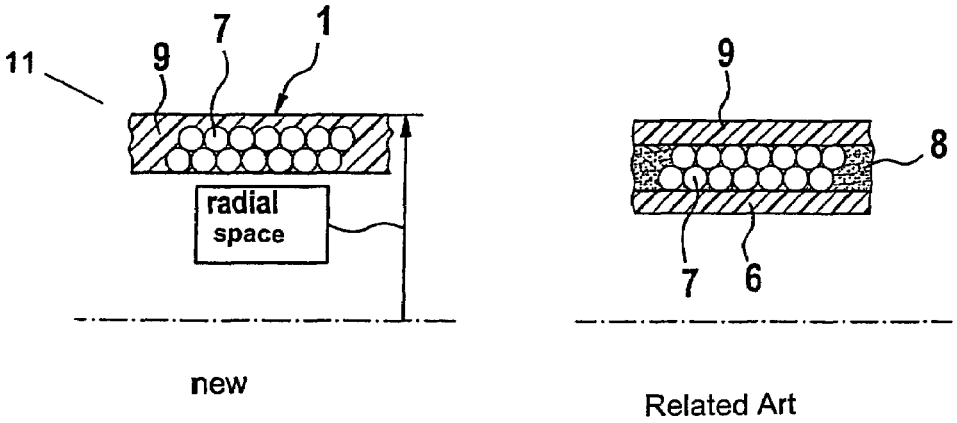
PRIOR ART Fig. 2
FIG. 2 shows a schematic illustration of an embodiment according to the present invention beside an example of the related art for purposes of comparison with the present invention.

FIG. 1 shows a radial cross-section through a pencil-style ignition coil 1. Essentially, it includes a core 2, around which is arranged a secondary bobbin 3 having a secondary winding 4. A casting resin layer is then provided on the secondary winding, and a primary bobbin 6 including its primary wire 7 being situated on this casting resin layer 5. Pencil-style ignition coil 1 is insulated by a radial sheath of casting resin 8 and an encapsulation layer 9.

To produce the embodiment of a structural component 11 according to the present invention including the primary winding, the primary wire 7 is wound around a metal spindle—not shown in the drawing. This metal spindle is also used as the internal slider for the encapsulation layer injection molding die. This winding of primary wire 7 together with the spindle is inserted as a unit into an encapsulation layer molding die, and the encapsulation layer including integrally injected primary winding made from enameled copper wire is produced in a single molding procedure.

When it is ejected from the mold, the result is a structural component 11 in which encapsulation layer 9 is inseparably attached to the molded winding of ignition coil 1.

The necessary wire contacts are produced in subsequent manufacturing steps for this component 11.

Alternatively, the primary winding (primary wire 7) may also have the form of a baked enamel winding. In this case, the spindle does not have to be used as the internal slider for the injection molding die. The baked enamel winding may be placed in the die as an insertion part, and the internal slider may remain fixed in the tool.

What is claimed is:

1. A pencil-style ignition coil comprising:

a bobbin;

a primary winding;

a secondary winding; and an insulator radially separating the primary and secondary windings from each other, wherein the primary winding is cast as a structural component in a cylindrical ring element formed by an extrusion procedure and forming a housing of the ignition coil, the primary winding being integrated into the housing, such that the primary winding is not wound onto an outer circumference of the bobbin.

2. The ignition coil according to claim 1, wherein the primary winding includes a primary wire.

3. The ignition coil according to claim 1, wherein the structural component is used as an encapsulation layer of the ignition coil.

* * * * *